United States Patent [19]

Rupp et al.

[11] Patent Number: 4,919,187

[45] Date of Patent: Apr. 24, 1990

[54] METHOD FOR MAKING ADDITIONS TO MOLTEN ALLOYS AND BODIES MOLDED FROM ALLOYING METALS

[75] Inventors: Hartwig Rupp, Frankfurt am Main; Otto Stenzel, Grundau, both of Fed. Rep. of Germany

[73] Assignee: Leybold Heraeus GmbH, Cologne, Fed. Rep. of Germany

[21] Appl. No.: 230,707

[22] Filed: Aug. 9, 1988

Related U.S. Application Data

[63] Continuation of Ser. No. 908,332, Sep. 17, 1986, abandoned.

[51] Int. Cl.[5] ..... C22C 21/00; B22D 19/16

[52] U.S. Cl. ..... 164/57.1; 420/528; 164/98

[58] Field of Search ..... 164/98, 55.1, 56.1, 164/57.1, 58.1, 59.1; 75/51.4; 420/528

[56] References Cited

U.S. PATENT DOCUMENTS

Re. 29,035 11/1976 Herchenroeder et al. ..... 164/59.1
3,922,166 11/1975 Koros et al. ..... 164/57.1
4,402,743 9/1983 Morykwas ..... 164/59.1
4,424,853 1/1984 Khandros et al. ..... 164/57.1

FOREIGN PATENT DOCUMENTS 59-159248 9/1984 Japan ..... 164/98

*Primary Examiner*—Kuang Y. Lin
*Attorney, Agent, or Firm*—Felfe & Lynch

[57] ABSTRACT

Method for the charging and controlled addition of prealloys to molten alloys of metals reactive and nonreactive at room temperature which are held in a crucible. To permit pre-alloys with a high percentage of reactive metal to be worked more easily, a casting is produced from the reactive and nonreactive metals by a casting process followed by solidification. This casting is nonreactive at its surface at room temperature and its average content of reactive metal is equal to or greater than the reactive metal content in the crucible. Such castings are added to the crucible according to the need for the reactive metal. In an especially advantageous manner, a casting produced in a casting mold in a nonreactive atmosphere has at least at its surface such a content of nonreactive metal that it is stable at room temperature.

10 Claims, 2 Drawing Sheets

FIG.1
PRIOR ART
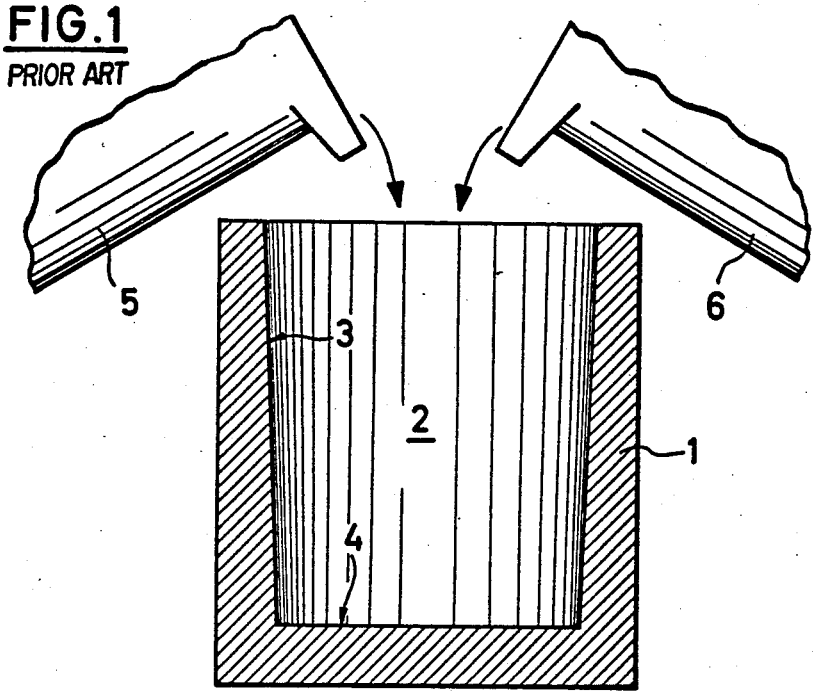
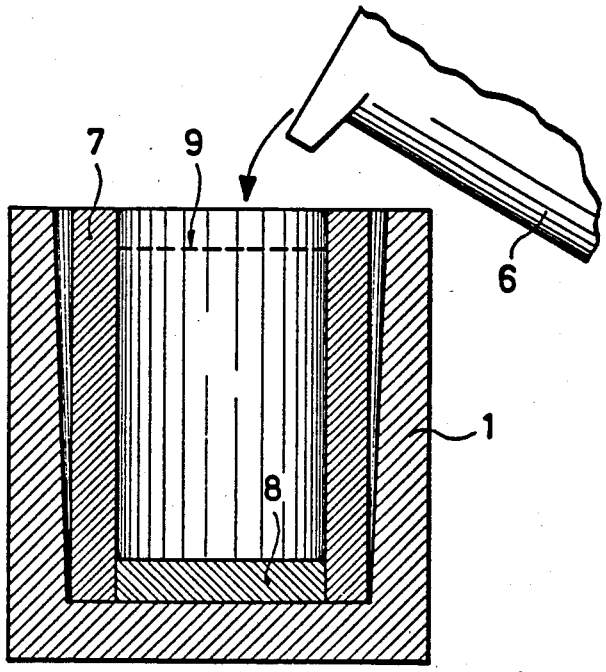
FIG.2

METHOD FOR MAKING ADDITIONS TO MOLTEN ALLOYS AND BODIES MOLDED FROM ALLOYING METALS

This is a continuation of application Ser. No. 908,322, filed Sept. 17, 1986, now abandoned.

BACKGROUND OF THE INVENTION

The invention relates to a method for the charging and controlled addition of pre-alloys to molten alloys of room-temperature-reactive and -nonreactive metals contained in a crucible.

An example of an alloy of room-temperature-reactive and -nonreactive metals is an aluminum alloy containing about 3 percent of lithium by weight, in which other alloy elements such as magnesium, for example, may also be contained. Such alloys are important in aviation, because they reduce the weight of aircraft accordingly, so that the saving in fuel costs over the total life of the aircraft is several times greater than the additional cost of such an alloy.

In the transformation of such alloys to sheets, extrusions and rough castings, waste is produced to a considerable degree, and when defective pieces are returned they constitute scrap. Both the wastes and the scrap are put through a recycling process in which melting plays an important part. In the melting, the reactive metals—lithium for example—tend to evaporate, and the metal being worked will not have in every case the prescribed content of the reactive alloy elements. In this case the basic metal—aluminum for example—must be treated with a greater percentage of the reactive metal.

If lithium has to be added, the storage and handling of this metal is complicated, because alloys containing more than 6 to 8 percent of lithium by weight are decidedly reactive even at room temperature, so that such alloys are no longer easy to handle. To compensate lithium losses in recycling it is very desirable to use pre-alloys whose lithium content is definitely greater than 3 percent by weight.

The invention is addressed to the problem of devising a method of the kind described in the beginning, in which pre-alloys are used which have a reactive metal content which is decidedly greater than the content of the reactive metal in the melt or in the end product, without any tendency on the part of the pre-alloy in question to react with the ambient air at room temperature.

SUMMARY OF THE INVENTION

The solution of the stated problem is accomplished in accordance with the invention, in the method described in the beginning, by producing by a casting method from the reactive and nonreactive metals a casting which after solidification is nonreactive at its surface at room temperature, and whose content of the reactive metal is equal to or greater than the reactive-metal content in the crucible, and by adding such castings to the crucible according to the need for the reactive metal.

It has been found that it is possible, for example, to produce a casting in which up to 10 percent by weight of lithium is uniformly distributed, while the balance consists at least substantially of aluminum. A casting of this kind is sufficiently stable at room temperature to permit it to be fed, without any additional casting, through a lock into a crucible which is under a vacuum or contains some other nonreactive atmosphere. It is to be noted that the lithium content by volume is correspondingly greater, since the ratio of the specific weight of lithium to that of aluminum is about 1:5.

If pre-alloys are required which have a content of lithium that is appreciably greater than that, it is especially advantageous to proceed by producing in a mold, in a nonreactive atmosphere, a casting which has, at least at its surface, such a content of nonreactive metal that it is stable at room temperature.

A method of this kind can be practiced, for example, by first preparing a hollow body of nonreactive metal in a mold and filling the cavity with an alloy of reactive and nonreactive metal.

The hollow body can be prepared by producing the hollow body on a mold by centrifugal casting, in a first step, the mold being, of course, a centrifugal casting mold. Or, as an alternative, it can be produced by inserting a tube of the nonreactive metal into a stationary casting mold.

Again, it is especially advantageous to make the end closures of the hollow body of nonreactive metal, for example by inserting appropriately shaped plates into the ends of the hollow body, or by casting them in place.

The invention also relates to a casting made of alloying additives which at room temperature are partly reactive and partly nonreactive. To solve the same problem, such a casting, in accordance with the invention, is characterized by a surface casing of a metal that is nonreactive at room temperature.

BRIEF DESCRIPTION OF THE DRAWINGS

FIG. 1 is a schematic illustration of a method for the preparation of a pre-alloy containing a maximum of about 10 weight-percent of lithium, FIG. 2 is a schematic illustration of a method for the preparation of a pre-alloy inserted in a tubular jacket which is nonreactive.

DETAILED DESCRIPTION OF THE PREFERRED EMBODIMENTS

Figure 3:
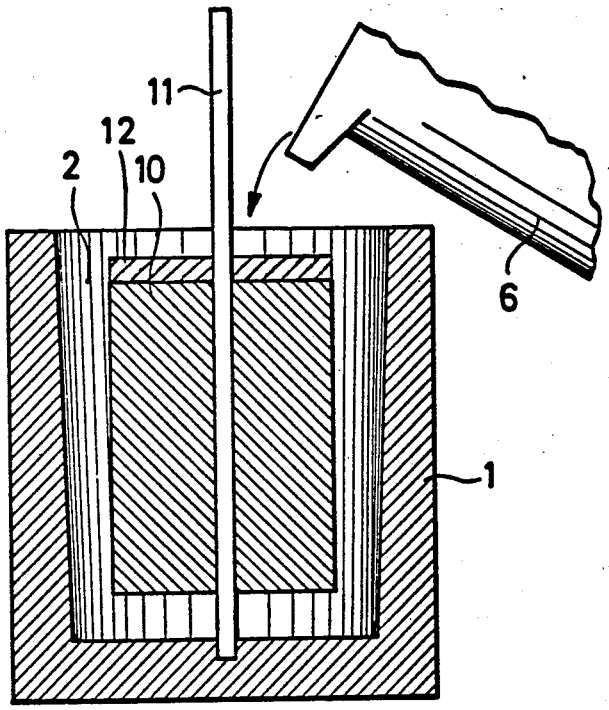
FIG. 3 is a schematic illustration of a method for the preparation of a pre-alloy with a core of an alloy that is reactive at room temperature, which is cast in place with a jacket of a nonreactive alloy.

In FIG. 1 there is shown one of the conventional molds 1 in which the cavity 2 is defined by a slightly tapering inner wall 3 and a bottom 4. Under a vacuum or under shielding gas the individual components of the pre-alloy are poured from two or more crucibles 5 and 6, represented only diagrammatically; several of these components can be contained in each of the crucibles 5 and 6. The amount of the reactive components is, however, to be no more than sufficient so that the casting that solidifies afterward in the cavity 2 will not be reactive at room temperature, because after the vacuum or shielding gas atmosphere has been removed the casting is bound to come in contact with the ambient air.

In the method illustrated in FIG. 2, a hollow cylindrical body 7 of a metal with a nonreactive composition is first prepared in the mold 1, and an end stopper in the form of a disk 8 is inserted into the body. The crucible 6 contains in this case an alloy having such a content of reactive metal that it would be able to react with the atmosphere. The molten metal is poured only up to the level 9 indicated by the broken line, and then the space remaining above it is filled with another end stopper, which is not shown here. The stoppers are affixed to the hollow body 7 such that they cannot come loose from the casting that is eventually formed.

In the method illustrated in FIG. 3, a body 10 in which the reactive metal is present is prepared so as to be equidistant at all points from the walls of the mold, and the space is then filled from the crucible 6 with a molten metal which is nonreactive at room temperature, or with a nonreactive alloy. The result is a casting which is not reactive at its surface and which represents a replica of the shape of cavity 2. A rod 11 of a metal which is nonreactive at room temperature serves to hold the body 10 in place. A plate 12 of an alloy which is nonreactive at room temperature prevents the body 10 from being "washed away" by the inflowing nonreactive alloy.

When pouring the molten metal, care is taken that the melting point of body 10 and the temperature at which the melt is poured from the crucible 6 are not too far apart from one another. Since the temperature of the body 10 is markedly below the pouring temperature of the molten metal and is preferably at room temperature, it is possible effectively to prevent any great part of the body 10 from being melted, although slight melting is not objectionable.

The so-called "cores" of the castings which are made by the methods according to FIGS. 2 and 3 may contain much larger amounts of the room-temperature-reactive metal; they can even consist entirely of the reactive metal if the alloy formula calls for it.

Instead of a reusable mold 1, the hollow body 7, if it has an end closure or bottom, can be used directly as a single-use mold.

We claim:

1. A method for the charging and controlled addition of a pre-alloy casting to a batch of molten alloys comprising:

forming a batch of molten alloys of metals in a heated crucible which is contained in a nonreactive atmosphere, the metals comprising lithium and a metal that is nonreactive at room temperature;

preparing a pre-alloy composite casting having a core portion and surface layer portion, the core portion having sufficient lithium to be reactive at room temperature, and the surface layer portion being nonreactive at room temperature, the preparing step comprising the steps of forming one portion of said composite, solidifying the one portion of the composite and then adding and solidifying the other portion so as to form a pre-alloy casting having an average content of lithium that is greater than the lithium content of the molten alloys in the crucible; and adding the pre-alloy casting to the batch of molten alloys in the crucible to add the prescribed amount of lithium to form an end product.

2. The method according to claim 1 wherein said pre-alloy casting is prepared by casting a batch of molten alloys which are reactive at room temperature in said surface layer portion to form said core portion, said surface layer portion being a hollow body.

3. The method according to claim 2 further comprising inserting an end stopper into the end of said hollow body after casting said core portion therein.

4. The method according to claim 1 wherein the end product is a single alloy.

5. The method according to claim 2 wherein casting the nonreactive metal of the surface layer portion to form the hollow body comprises centrifugal casting of the nonreactive metal in a rotating mold.

6. The method according to claim 1 wherein preparing the pre-alloy casting further comprises forming the core portion of lithium and nonreactive metal; positioning the core portion in a mold such that a space is defined between the surface of the core portion and inner walls of the mold.

7. The method according to claim 6 wherein forming the pre-alloy casting comprises filling the space between the core portion and mold with a batch of molten alloys which are nonreactive at room temperature to form the surface layer portion.

8. The method according to claim 1 wherein aluminum is used as a metal that is nonreactive at room temperature.

9. The method according to claim 6 wherein the core portion is positioned in the mold by a rod of a metal which is nonreactive at room temperature.

10. The method according to claim 7 wherein the core portion is covered with a plate of a metal which is nonreactive at room temperature, said non-reactive alloy being poured onto said plate, said plate preventing said core portion from being washed away by the inflowing nonreactive alloy as the surface layer portion is cast.

* * * * *